US007980290B2

(12) United States Patent
Heinrich et al.

(10) Patent No.: US 7,980,290 B2
(45) Date of Patent: Jul. 19, 2011

(54) MOLDING EQUIPMENT FOR THE PRODUCTION OF CASTINGS

(75) Inventors: Siegfried Heinrich, Laichingen (DE); Sascha Padovan, Oberuzwil (CH); Ulrich Binder, Oberuzwil (CH); Benno Niedermann, Niederglatt (CH)

(73) Assignee: Buhler Druckguss AG, Uzwil (CH)

( * ) Notice: Subject to any disclaimer, the term of this patent is extended or adjusted under 35 U.S.C. 154(b) by 260 days.

(21) Appl. No.: 12/299,099

(22) PCT Filed: Oct. 25, 2006

(86) PCT No.: PCT/CH2006/000598

§ 371 (c)(1),
(2), (4) Date: Oct. 30, 2008

(87) PCT Pub. No.: WO2007/131368

PCT Pub. Date: Nov. 22, 2007

(65) Prior Publication Data

US 2009/0071623 A1 Mar. 19, 2009

(30) Foreign Application Priority Data

May 11, 2006 (DE) ..... 10 2006 022 291

(51) Int. Cl.
*B22D 17/26* (2006.01)
*B22D 33/04* (2006.01)

(52) U.S. Cl. ..... 164/137; 164/341

(58) Field of Classification Search ..... 164/137, 164/341, 342, 343

See application file for complete search history.

(56) References Cited

U.S. PATENT DOCUMENTS

| | | | | |
|---|---|---|---|---|
| 3,596,708 | A | 8/1971 | Lapin | |
| 5,323,840 | A * | 6/1994 | Usui et al. | 164/332 |
| 5,865,241 | A | 2/1999 | Bishenden et al. | |
| 6,761,208 | B2 * | 7/2004 | Whealy et al. | 164/340 |
| 7,500,508 | B2 * | 3/2009 | Heinrich et al. | 164/312 |
| 7,669,639 | B2 * | 3/2010 | Whealy et al. | 164/340 |

FOREIGN PATENT DOCUMENTS

| | | |
|---|---|---|
| JP | 2-175063 | 7/1990 |
| WO | WO 2004/033131 | 4/2004 |

* cited by examiner

*Primary Examiner* — Kevin P Kerns
(74) *Attorney, Agent, or Firm* — Merchant & Gould P.C.

(57) ABSTRACT

A mold device produces cast parts, in particular cast parts of complex shape, such as engine blocks, for example with 2 to 8 cylinders arranged in a row, wherein the mold device can be used, in particular, in die casting machines. The mold device has both a movable clamping plate and a permanently fixed clamping plate with movable or permanently fixed mold halves arranged thereon, wherein a water jacket insert or contour insert is placed in the movable mold halves, and the contour insert (11) is movable linearly.

1 Claim, 2 Drawing Sheets

MOLDING EQUIPMENT FOR THE PRODUCTION OF CASTINGS

Figure 1:
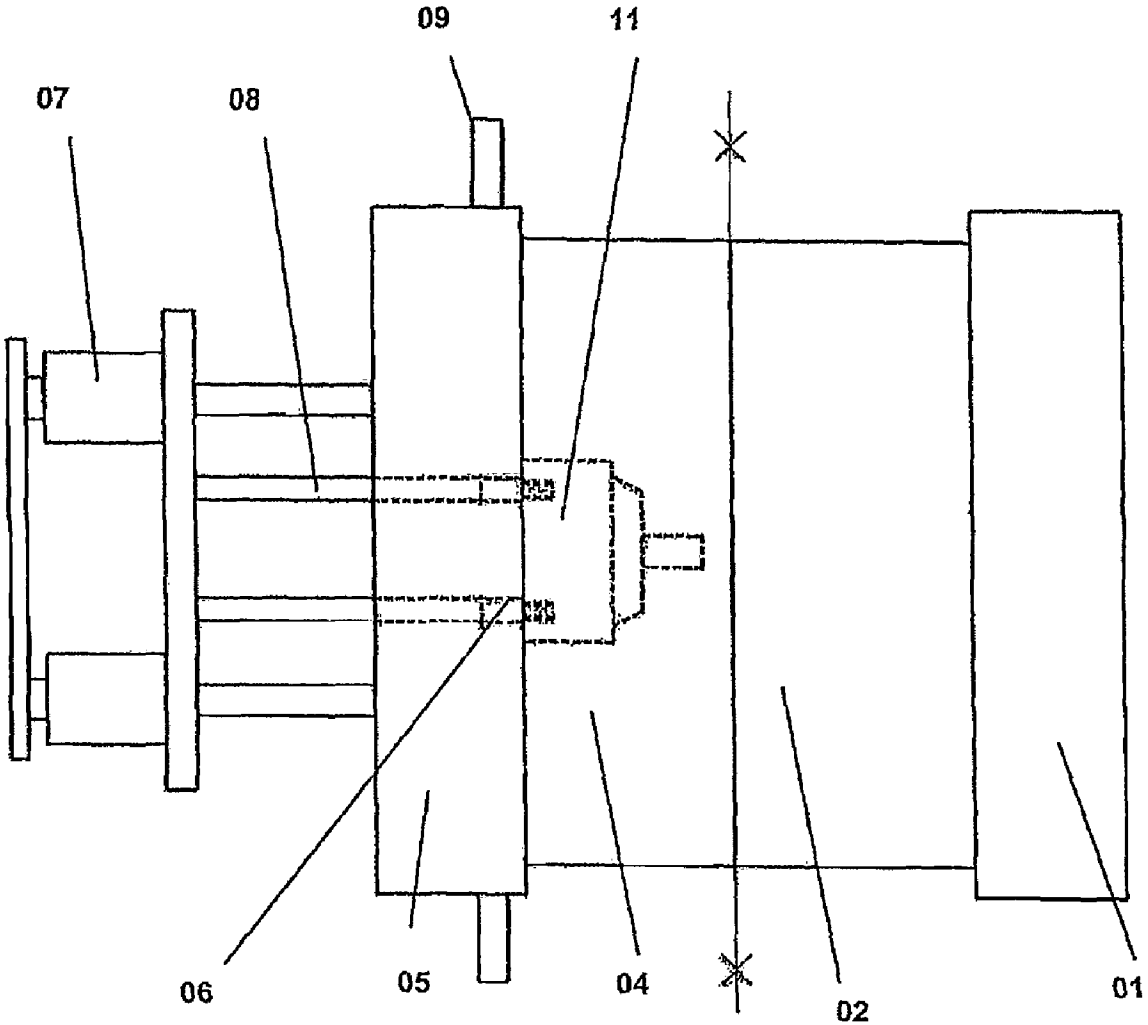

This application is a National Stage Application of PCT/CH2006/000598, filed 25 Oct. 2006, which claims benefit of Ser. No. 10 2006 022 291.1, filed 11 May 2006 in Germany and which applications are incorporated herein by reference. To the extent appropriate, a claim of priority is made to each of the above disclosed applications.

The invention relates to molding equipment for the production of castings, in particular of complex shape castings, such as engine blocks with an in-line cylinder arrangement, e.g. 2 to 8 cylinders. The molding equipment is especially applicable in die casting machines.

U.S. Pat. No. 5,865,241 reveals a die casting machine for the production of V engine blocks in a mold with a fixed and a mobile mold half. The mobile mold half comprises of a mold cavity and a pin-guided ejector block. On a clamping plate there is an ejector box which can be lifted from it via a double-acting cylinder. The cylinder protrudes the side of the clamping plate not facing the mold.

On the level of the mold cavity, further cylinders are arranged perpendicular to this cylinder on both sides which serve to retract and extend slides.

The ejector box is a massive plate which accommodates part of the cylinder stated first and whose cross section has the form of a trapezoid. On the inclined side walls which have the same angle as the V position of the engine block, there is also a double-acting ejector cylinder each, with inserts for the engine cylinders whose axes would cross in the mold cavity if they were actually elongated. Due to the attachment of these cylinders to the inclined sides, horizontal and vertical force components act on the ejector box when the castings are being ejected.

For opening and closing the mold, further cylinders are required.

A similar molding and die-casting machine is described in WO 2004/033131 where two further hydraulic cylinders are provided to move the mobile mold half.

This cylinder arrangement also considerably protrudes the side of the mobile mold half not facing the mold.

The described molds involve a lot of design work and are very large. Therefore an enormous weight must be moved by the die casting machine.

Molds for casting engine blocks of in-line engines are already known which are equipped with a cooling jacket insert to quickly cool thin-walled interior areas. In these molds, the water jacket and/or its insert are exposed to the molten metal too long, which means that the respective service life is low and/or irregular and they must already be replaced after 5000 to 15000 shots which is time and cost consuming.

The invention is consequently based on the task of creating molding equipment for the production of castings, in particular of complex castings, such as engine blocks of in-line engines allowing the replacement of specific inserts such as water jacket inserts with less time being required.

The water jacket insert (with sleeves) is executed as a slide which is releasably connected with the machine ejector.

The invention is based on the actually known findings that a longer service life of a water jacket insert can only be achieved if it has less contact with the cooling molten metal as this will lead to lower repair costs.

This can be achieved by means of a simpler tool design and shorter extracting periods which again lead to shorter cycle times and higher productivity.

Another task consist in creating a procedure for removing water jacket inserts from molds for in-line engines or the like which enable to quickly replace the water jacket inserts.

Figure 2:
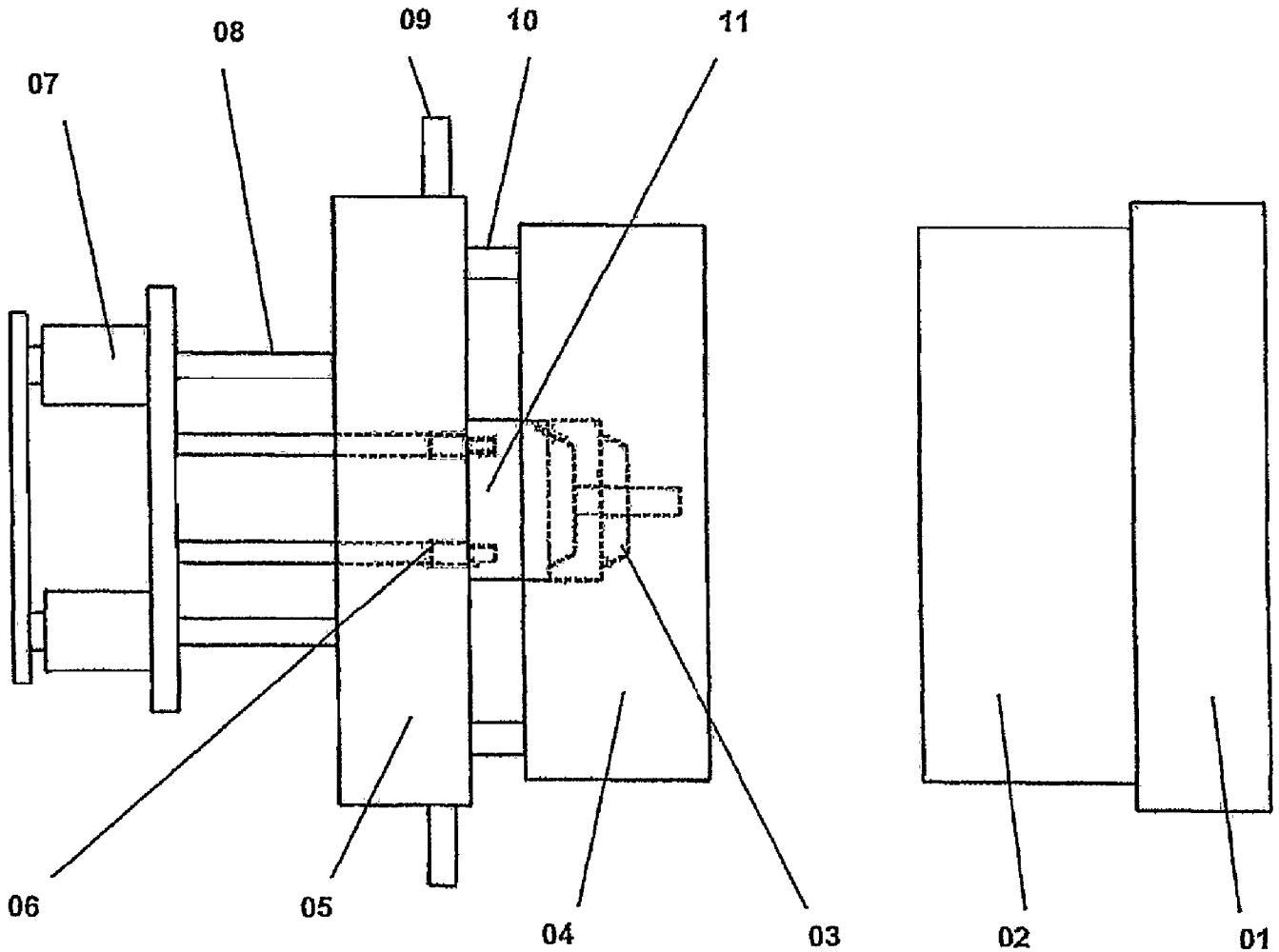

In the following, the invention is described in more detail in an embodiment example by drawings, wherein FIG. 1 shows a closed mold and the drawing FIG. 2 shows an open mold.

A vertically arranged molding equipment of a die casting machine comprises of a fixed clamping plate 1 with a fixed mold half 2 and a mobile clamping plate 5 with a mobile mold half 4. The mobile mold half 4 has a recess 3 for lifting the mobile contour insert 11.

Connecting bars 8 are integrated between the ejector unit 7, which is connected with the mobile clamping plate 5 of the die casting machine, and the mobile contour insert 11. The mobile mold half 4 exhibits locking bolts 10 between the mobile mold half 4 and the mobile clamping plate 5. Cylinders 9 of a hydraulic quick clamping system of the mold are installed at the mobile clamping plate 5.

A connection 6 is provided between the mobile contour insert 11 and the ejector unit 7.

The water jacket insert (contour insert 11) with sleeves is executed as a slide and permanently connected with the ejector unit 7. The slide is guided by means of four connecting bars 8 (guide pins) in the machine shield (mobile clamping plate 5). A hardened plate is installed as a slide support in the machine shield.

After injecting the molten light metal into a mold to cast the engine block of an in-line engine and after the expiry of the first solidification period, the release of the quick clamping system 9 of the mold is extracted, the mobile clamping plate 4 is shifted/opened by approx. 10 cm and the ejector unit 7 is triggered in the forward direction. Subsequently the release is retracted and the ejector unit 7 is triggered in the reverse direction. Then the contour insert 11 with sleeves is extracted and after the expiry of a second solidification time, the mold is opened. Top and bottom slides which are not described in more detail open and a removal device which is not shown can approach the casting and grab it. Afterwards the lateral slides which are not described in more detail open and the removal device can remove the casting. Consequently, the contour insert 11 (water jacket insert) can already cool down at an early point in time and is subject to less stress.

Finally, the mold is sprayed as usual, the ejector unit 7 advances, the cylinder liners are inserted. The mold is closed, the release of the quick clamping system 9 is retracted and the next shot can take place.

The mobile contour insert 11 itself can also be disassembled and exchanged. To this end, the release of the quick clamping system 9 of the mold is extracted with the mold closed and then the ejector 7 is triggered in the forward direction so that the mobile clamping plate 5 can advance. Subsequently, the entire slide can be removed and a new contour insert 11 can be installed.

REFERENCE NUMBERS

1 Fixed clamping plate

2 Fixed mold half

3 Recess

4 Mobile mold half

The invention claimed is:

1. Method for the production of engine blocks of in-line engines, by molding equipment comprising a mobile clamping plate and a fixed clamping plate with a mobile and/or fixed mold half arranged next to the clamping plates, with the mobile mold half including a recess for a mobile contour insert, the mobile contour insert being a water jacket insert with sleeves, the recess liftably accommodating the mobile contour insert, with an ejector unit being connected with the mobile clamping plate and the ejector unit including a connection with the mobile contour insert, the method comprising:

opening the mobile clamping plate after expiry of a first solidification period, without the mobile mold half being opened;

triggering the ejector unit in a forward direction;

subsequently triggering the ejector unit in a reverse direction, which causes the water jacket insert to advance; and after expiry of a second solidification period, opening the molding equipment.

* * * * *